United States Patent [19]

Moscovich

[11] 4,397,463

[45] Aug. 9, 1983

[54] BALL GAME

[76] Inventor: Ivan Moscovich, 19 Elkachi St., Afek-Ramat Aviv, Israel

[21] Appl. No.: 377,521

[22] Filed: May 12, 1982

[51] Int. Cl.[3] ..... A63F 7/02

[52] U.S. Cl. ..... 273/1 GE; 273/86 C

[58] Field of Search ..... 273/1 G, 1 GE, 1 GF, 273/86 C

[56] References Cited

U.S. PATENT DOCUMENTS

| | | | |
|---|---|---|---|
| 3,612,527 | 10/1971 | Rogerson | 273/1 GF X |
| 3,712,621 | 1/1973 | Ames | 273/1 GE X |
| 3,883,137 | 5/1975 | Bengtson | 273/86 C X |

FOREIGN PATENT DOCUMENTS

| | | | |
|---|---|---|---|
| 2046105 | 11/1980 | United Kingdom | 273/86 C |

*Primary Examiner*—Paul E. Shapiro

*Attorney, Agent, or Firm*—Benjamin J. Barish

[57] ABSTRACT

A game to be played by two players is described, including a set of ten differently-colored balls for each player adapted to be placed in random at the upper ends of a set of inclined chutes for each player formed in a common base member. The base member is further formed with two inclined passageways, both traversed by a common gate member such that the higher-elevational end of each passageway is on one side of the gate and is adjacent to the lower ends of its set of chutes, whereas the lower-elevational end of each passageway is at the opposite side of the gate. The game further includes a set of display cards, each marked with a different sequence of the colored balls. Each round of the game is played by turning-up one of the display cards, whereupon each player flips his balls so as to roll them down the chutes and to enter the respective passageway in the same sequence as in the card displayed. As soon as one player has completed the sequence with his balls, he moves the common gate member to block any further balls entering either passageway from either set of chutes.

10 Claims, 1 Drawing Figure

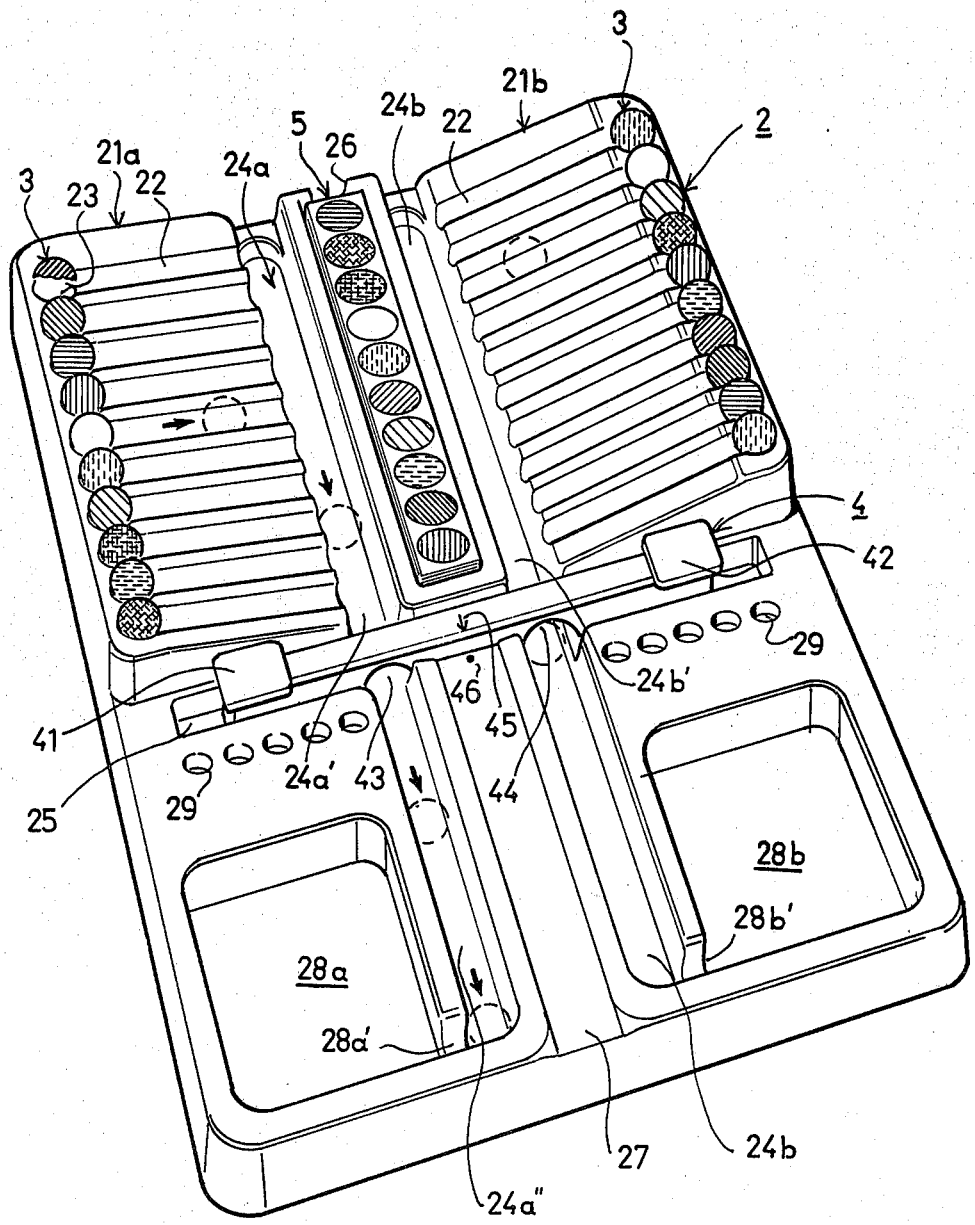
3
21b
2
24b
22
5
26
21a
24a
3
23
22
4
42
29
24b'
46
45
41
24a'
43
44
25
29
28b
28b'
28a
28a'
27
24b
24a''

BALL GAME

BACKGROUND OF THE INVENTION

The present invention relates to a ball game, and particularly to a game in which one player moves colored balls, in competition with another player, in a manner requiring dexterity, skill, coordination, and even some planning, in order to win.

SUMMARY OF THE INVENTION

According to a broad aspect of the present invention, there is provided a game adapted to be played by a plurality of players, comprising a set of balls for each player, with each set including a like plurality of balls each visually distinguishable from the others of the set; and a set of inclined chutes for each player, each set including one chute for each ball of the set and being formed to stably support one of the balls at the upper end of the chute. The game further includes an inclined passageway for each set of chutes, each passageway including an inclined higher-elevation section at one end communicating with the lower ends of all the chutes in the respective set, and an inclined lower-elevation section at the opposite end. The arrangement is such that the balls of the respective set may roll by gravity down their chutes in a parallel manner to the higher-elevation section of the passageway of the respective set, and from there in a serial manner to the lower-elevation section of the respective passageway.

The preferred embodiment of the invention described below is intended for playing by two players, and therefore includes two sets of color-distinguishable balls, two sets of chutes, and two of such inclined passageways.

The described game further includes a gate member extending transversely across the two passageways to divide each into its two sections. This gate member is movable either to a first position wherein it establishes communication between the two sections of the two passageways, or to a second position wherein it blocks communication between the two sections of the two passageways.

Further included in the described embodiment is a set of display cards, each marked with a different sequence of colored balls to be matched by each player when playing the game.

When playing the game, each player positions his set of balls, in random fashion, at the upper end of his set of chutes, and then one of the display cards is turned over to display a particular sequence of colored balls. Each player then, as quickly as he can, flips his balls so that the roll down the chutes and enter the respective passageway in the same sequence as appearing in the card displayed. As soon as one player has successfully done this, he quickly moves the common gate member to the closed position, thereby blocking any further balls either by him or by his opponent.

Thus, in playing the game, a considerable degree of skill, dexterity and coordination is required to flip the balls in the required sequence. A time element is also involved requiring a certain measure of planning, since the chutes are located at different distances from the gate, and therefore the time required for the balls to traverse these different distances in order to arrive at the gate in the required sequence, must also be taken into account.

Further features and advantages of the invention will be apparent from the description below.

BRIEF DESCRIPTION OF THE DRAWINGS

The invention is herein described, by way of example only, with reference to the accompanying single drawing FIGURE illustrating one preferred embodiment of a game constructed in accordance with the present invention.

DESCRIPTION OF A PREFERRED EMBODIMENT

The embodiment of the invention illustrated in the drawing is intended for playing by two players. Briefly, it includes a common base member 2; a set of differently-colored balls 3 for each of the two players, each set being constituted of ten balls; a common gate member 4, manipulatable by either of the players to a gate-opening or to a gate-closed position; and a set of display cards 5, each marked with a different sequence of colored balls to be matched by the players when playing the game.

More particularly, the common base member 2 is constituted of a single plastic sheet vacuum-formed with a peripheral wall, for stably supporting the base on a horizontal table. The base 2 is also formed with a set of chutes 21*a*, 21*b* for each of the two players, each set of chutes being formed at an incline with the outer ends of the chutes at a higher inclination than their inner ends. Each set 21*a* 21*b* of chutes includes ten parallel chutes 22, namely, one for each of the balls 3 of the respective set, with each chute being formed with a semi-spherical or dished depression 23 at its upper end for stabling supporting one of the balls 3.

The lower ends of all the chutes 22 of each set 21*a*, 21*b* lead to an inclined passageway 24*a*, 24*b* formed in the common base member 2 for each of the two sets 21*a*, 21*b*. Each of these inclined passageways is composed of two undivided sections, namely a first or proximal section 24*a'*, 24*b'* bordering the ten chutes 22 of its respective set 21*a*, 21*b*; and a second, or distal section 24*a''*, 24*b''* at the opposite end of the passageway. Each passageway 24*a*, 24*b* is formed at an incline such that its right-most end 24*a'*, 24*b'* bordering the chutes 22 is at a higher inclination than its section 24*a''*, 24*b''* at the opposite end of the common base member 2, this inclination being gradual and uniform from one end to the opposite end of the respective passageway.

Base member 2 is further formed with a recess 25 for receiving the common gate member 4, which recess extends transversely across the two inclined passageways 24*a*, 24*b*, so as to divide each into the above-mentioned two sections 24*a'*, 24*a''* and 24*b'*, 24*b''*. Recess 25 is longer than the gate member 4 to permit the latter to be moved by the players, as will be described below.

Base member 2 is also formed with a pair of tables 26 and 27. Table 26 is located between the two passageways 24*a*, 24*b*, co-extensive with the proximal sections 24*a'*, 24*b'* of these passageways on one side of the gate-receiving recess 25; and table 27 is located on the opposite side of the gate-receiving recess 25 between and co-extensive with the distal passageway sections 24*a''*, 24*b''*. Both tables are of the same size as the display cards 5. Table 26 is arranged to receive a turned-up card at the beginning of each round of play and to display the ten colored balls on the card aligned with the ten chutes 22 of each of the two sets 21*a*, 21*b*. Table 27 is similarly adapted to receive each display card 5, but after it has been played and the respective round of the game has been completed, in order to check whether the balls received in the distal sections 24a'', 24b'' of the two passageways 24a, 24b correspond to the sequence of colored balls in the respective display card played for that round.

Base 2 is further formed with a collector space 28a, 28b for each of the two players. Each collector space communicates with the distal passageway section 24a'', 24b'' via a small ledge 28a', 28b', such that the balls received in the passageway section are retained therein, but by convenient manipulation over ledge 28a', 28b' may be moved to the respective collector space 28a, 28b to facilitate their repositioning at the upper ends of respective set 21a, 21b of chutes 22 for another round of play.

Finally, base member 2 is formed with a plurality of dimples or depressions 29a, 29b adjacent to each of the collector spaces for receiving scoring pins or balls (not shown).

Gate 4 is in the form of a slide movable within recess 25 of the common base member 2. It includes a finger-piece 41 at one end for one of the players, and another finger-piece 42 at the opposite end for the other player. Gate 4 is further formed at its lower end with two semi-circular cut-outs or openings 43, 44 spaced from each other the same distance as the spacing between the two inclined passageways 24a, 24b for the two players.

As indicated earlier, gate member 4 may be moved within recess 25 to either a gate-opening position or to a gate-closing position. The gate-opening position is illustrated in the drawing, wherein it will be seen that the two semi-circular openings 43, 44 of the gate member are aligned with the two inclined passageways 24a, 24b, thereby permitting the balls to move, by gravity, from one end to the opposite end of each passageway. This gate-opening position of gate member 4 is indicated by an arrow 45, marked centrally of the gate, being aligned with a circle 46, marked at the end of table 27.

As will be described below, each player, by engaging his finger-piece 41, 42, may move the gate 4 in either direction (i.e., up or down, in the drawing) to a gate-closing position wherein the semi-circular cut-outs 43, 44 are no longer aligned with the inclined passageways 24a, 24b. Thus, in this gate-closing position, the gate blocks communication between the two sections at both passageways.

The set of display cards 5 may include any desired number of such cards, each marked on one face with a different sequence of the colored balls to be matched by each player when playing the game. As an example, the game could include in the order of 30 or 40 such display cards 5. Both tables 26 and 27 would be dimensioned so as to accommodate all the display cards in the set.

The game illustrated in the drawing may be played in the following manner:

First, all the display cards 5 are stacked face-down on table 26 between the two sets 21a, 21b of chutes 22. In addition, the gate 4 is moved to the illustrated gate-open position, with its semi-circular openings 43, 44 aligned with the two inclined passageways 24a, 24b, which open position is indicated by its arrow 45 being aligned with the circular mark 46. Each player, having received one set of the ten differently colored balls 3, then arranges his set in random manner at the upper ends of his set 21a, 21b of chutes 22, where the balls are stably supported by the recesses 23 at the upper ends of the chutes.

When both players have thus arranged their balls 3 in random fashion, the uppermost display card 5 is turned face-up so as to display one sequence of colored balls. As soon as that sequence is revealed, each player, as quickly as possible, flips the balls at the upper end of his set 21a, 21b of chutes 22 so that each ball rolls down the respective chute, enters the proximal sections 24a', 24b' of the respective inclined passageway 24a, 24b, and then rolls through openings 43, 44 of the open gate 4 into the distal sections 24a'', 24b'' of the respective passageway. As soon as one player has succeeded in causing all ten balls of his set to enter the latter section of his passageway in the correct sequence displayed by card 5, he moves gate 4 in either direction within recess 25, causing openings 43, 44 of the gate to move out of alignment with the two inclined passageways 24a, 24b, whereby the gate blocks any further balls rolling down either of the two passageways.

The displayed card 5 may then be transferred from table 26 to table 27, wherein it may be used to facilitate checking the balls within passageway sections 24a'', 24b'', to see whether they correctly match the sequence of that particular display card.

Any suitable arrangement may be used for scoring the game, such as by allotting the winner a point for each ball which his opponent was unsuccessful in moving to his distal passageway section 24a'', 24b'' before the gate was closed, but subtracting a predetermined number of points if the person who actuated the gate failed to correctly match the displayed sequence of the balls before closing the gate.

When one round of the game has been completed, the balls may be manipulated into the respective collector space 28a, 28b, and from there re-positioned, again in random fashion, to the upper ends of the chutes 22 for another round, which would be instituted by turning-up the next display card 5.

While the invention has been described with respect to one preferred embodiment, it will be appreciated that many variations could be made. For example, the game could be adapted for playing by more than two players, all competing with each other, by having the appropriate number of sets of balls, sets of chutes, and inclined passageways, with the latter arranged so as to be traversed by a common gate member. In addition, the gate could be omitted, in which case the players themselves would have to observe when the round was completed. Alternatively, the gate could be automatically actuated, for example, by an electrical or mechanical arrangement which detects when the last ball has entered the respective passageway section.

Many other variations, modifications and applications of the invention will be apparent.

What is claimed is:

1. A game adapted to be played by a plurality of players, comprising:

a set of balls for each player, each set including a like plurality of balls each visually distinguishable from the others of the set;

a set of inclined chutes for each player, each set including one chute for each ball of the set and being formed to stably support one of such balls at the upper end of the chute;

and an inclined passageway for each set of chutes, each passageway including an inclined higher-elevation section at one end adjacent to and communicating with the lower ends of all the chutes in the respective set, and an inclined lower-elevation section at the opposite end, such that the balls of the respective set may roll by gravity down their chutes in a parallel manner to said higher-elevation section of the respective passageway, and from there in a serial manner to said lower-elevation section of the respective passageway.

2. The game according to claim 1, further comprising gate means controllable either to establish communication, or to block communication, between the two sections of all the passageways simultaneously.

3. The game according to claim 2, wherein said gate means comprises a gate member common to all said passageways and disposed to divide each passageway into said two sections, said gate member being movable either to a first position wherein it establishes communication between the two sections of all the passageways, or to a second position wherein it blocks communication between the two sections of all the passageways.

4. The game according to claim 3, wherein said gate member includes a gate opening for each of said passageways and is movable transversely to all said passageways either to said first position wherein its gate openings are located to establish communication between the two sections of all the passageways, or to said second position wherein its gate openings are located to block communication between the two sections of all the passageways.

5. The game according to claim 4, wherein all said chutes and passageways are formed on a common base member.

6. The game according to claim 5, wherein there are two sets of balls, two sets of chutes, and two of said inclined passageways, for playing by two players; said gate member being slidable in a recess formed in said common base member transversely across said two passageways between the two sections thereof.

7. The game according to claim 6, further including a set of display cards each marked with a different sequence of colored balls to be matched by each player when playing the game.

8. The game according to claim 7, wherein said common base member includes a first table located parallel to and between said higher-elevation sections of the two passageways for supporting said playing cards at the beginning of a playing round, and a second table located parallel to and between said lower-elevation sections of the two passageways for supporting said playing cards at the end of a playing round.

9. The game according to claim 8, wherein said common base member is further formed adjacent to each of the two lower-elevation passageway sections with a collector space for collecting said balls when removed from said lower-elevation passageway sections before being repositioned to the upper ends of said chutes.

10. The game according to claim 1, wherein there are ten differently-colored balls and ten inclined chutes in each set.

* * * * *